US007347215B1

(12) United States Patent
Birnbaum

(10) Patent No.: US 7,347,215 B1
(45) Date of Patent: Mar. 25, 2008

(54) ERGONOMIC CRUTCHES

(76) Inventor: Bernardo Birnbaum, 3212 NE. 211 Ter., Aventura, FL (US) 33180

( * ) Notice: Subject to any disclaimer, the term of this patent is extended or adjusted under 35 U.S.C. 154(b) by 0 days.

(21) Appl. No.: 11/531,953

(22) Filed: Sep. 14, 2006

(51) Int. Cl.
*A61H 3/02* (2006.01)

(52) U.S. Cl. ..... 135/66; 135/69; 135/71; 135/72; 135/82

(58) Field of Classification Search ..... 135/65–66, 135/68–69, 71–73, 75–76, 82, 910–911; 280/812–813, 821
See application file for complete search history.

(56) References Cited

U.S. PATENT DOCUMENTS

| | | | | | |
|---|---|---|---|---|---|
| 2,257,831 | A | * | 10/1941 | Wood | 280/812 |
| 2,690,188 | A | * | 9/1954 | Goddard | 135/72 |
| 3,335,735 | A | * | 8/1967 | Colegrove et al. | 135/69 |
| 4,121,605 | A | * | 10/1978 | Schmerl | 135/65 |
| 4,562,850 | A | * | 1/1986 | Earley et al. | 135/66 |
| D291,791 | S | * | 9/1987 | Bean | D12/130 |
| 4,786,082 | A | * | 11/1988 | Swietlik | 280/812 |
| 4,834,366 | A | * | 5/1989 | Hotchkiss | 482/122 |
| 5,339,849 | A | * | 8/1994 | Stutz | 135/66 |
| 5,458,145 | A | * | 10/1995 | Davis | 135/68 |
| 5,606,985 | A | * | 3/1997 | Battiston et al. | 135/72 |
| 5,628,335 | A | * | 5/1997 | Free | 135/68 |
| 5,725,005 | A | * | 3/1998 | Yamasaki et al. | 135/73 |
| 5,771,910 | A | * | 6/1998 | Kluttz | 135/68 |
| 6,206,019 | B1 | * | 3/2001 | Horvitz | 135/74 |
| 6,286,529 | B1 | * | 9/2001 | Olivera | 135/82 |
| 6,397,868 | B1 | | 6/2002 | Smith | 135/66 |
| 6,470,900 | B1 | * | 10/2002 | Hamilton | 135/68 |
| 7,007,704 | B2 | * | 3/2006 | Luckstead | 135/65 |
| 7,025,072 | B2 | * | 4/2006 | McGrath | 135/75 |
| 7,104,271 | B2 | * | 9/2006 | Larson et al. | 135/73 |

FOREIGN PATENT DOCUMENTS

EP 1400229 A1 * 3/2004

* cited by examiner

*Primary Examiner*—Winnie Yip
(74) *Attorney, Agent, or Firm*—Sanchelima & Associates, P.A.

(57) ABSTRACT

An improved forearm or under arm crutch. The crutch features an extension which slides horizontally out of one of the handles and solidly connects to the tip of the other handle to form a stable seat where the user can rest. The crutch also features shock absorbing means. A shock absorbing means is at the foot of the crutch to cushion at the handle and another above the handle to independently cushion the forearm cuff or under arm pad. The crutch also features adjustable handles that articulate relative to the frame to comfortably accommodate users with various needs. The handle may also include a shock absorbing means integrated within the handle pad.

8 Claims, 6 Drawing Sheets

Fig 1
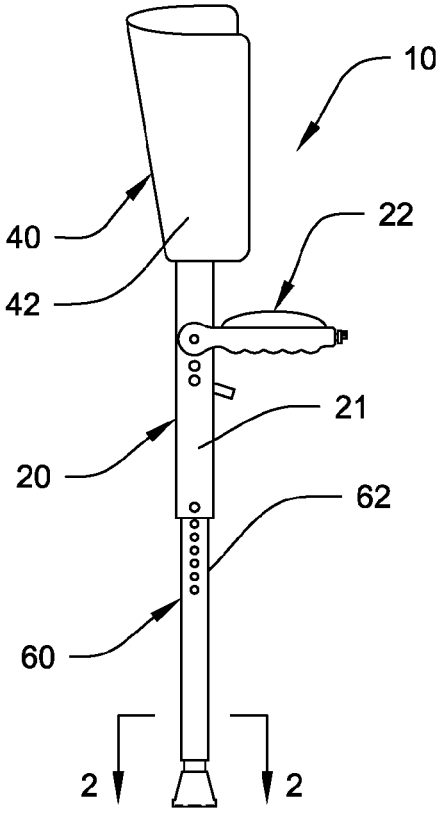
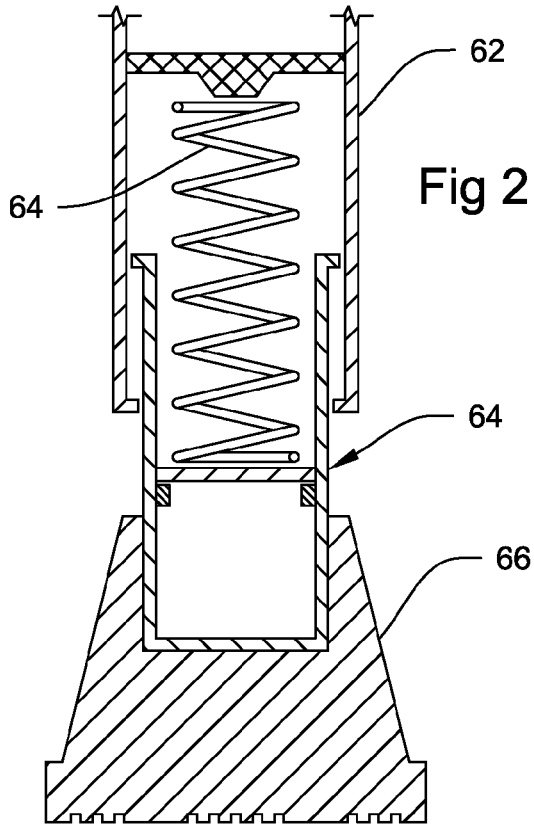
Fig 2
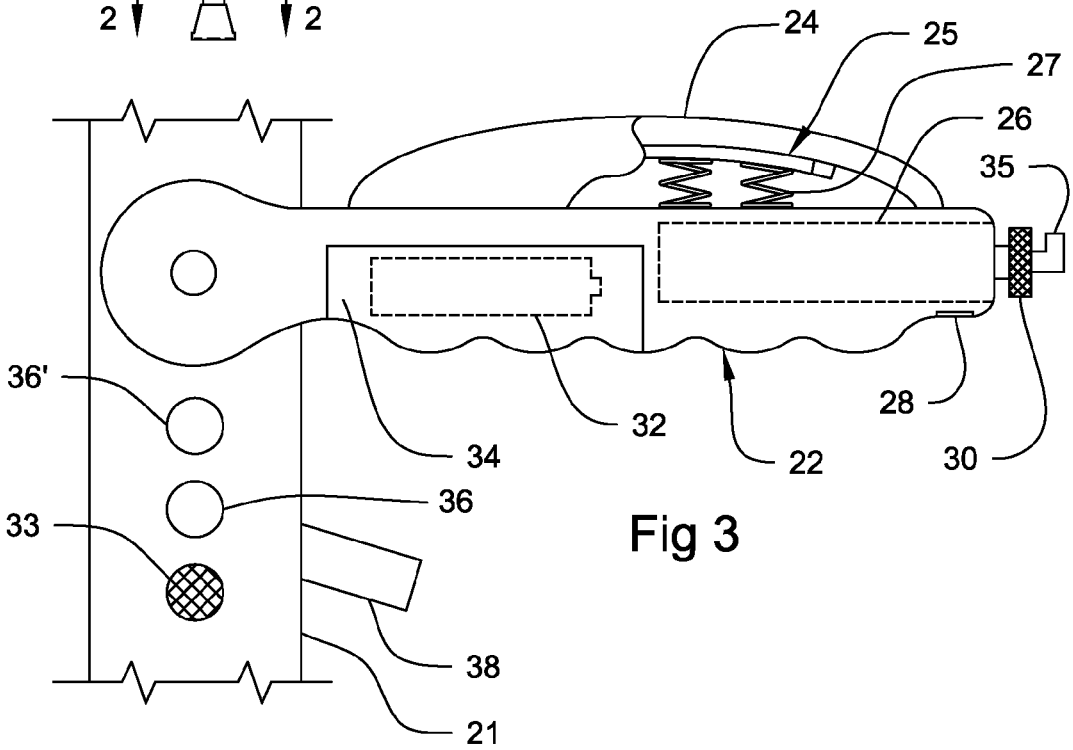
Fig 3

Fig 4
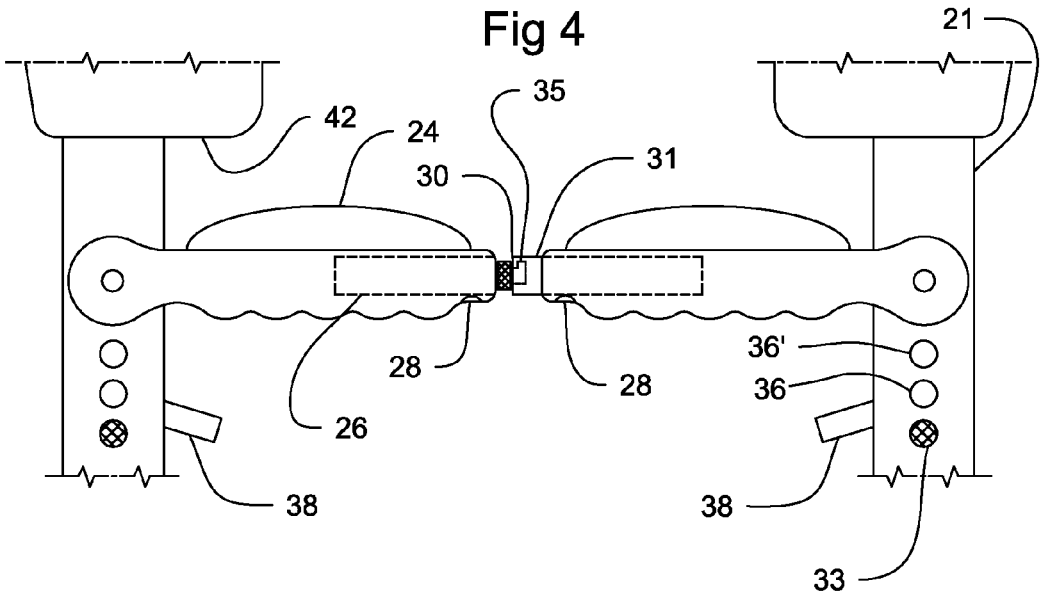
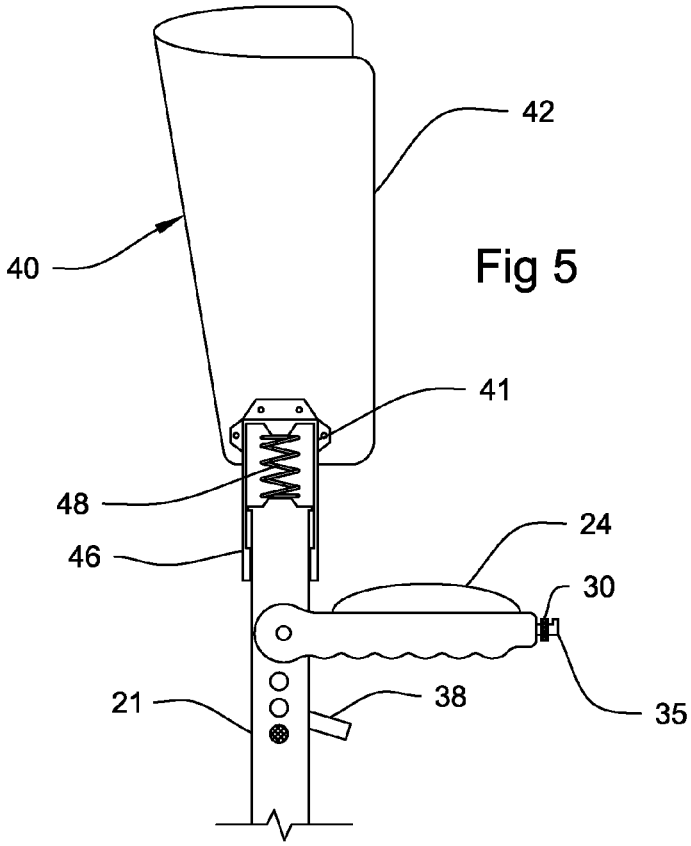
Fig 5

Fig 9
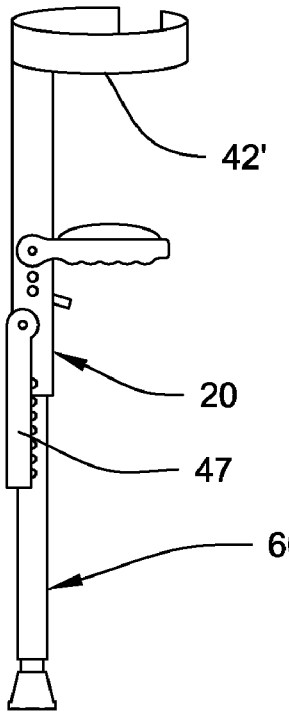
Fig 10
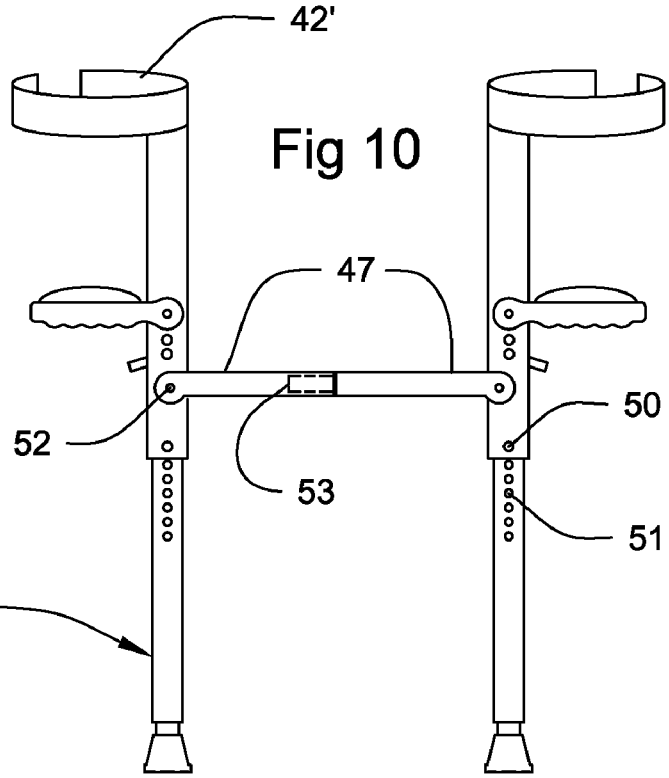
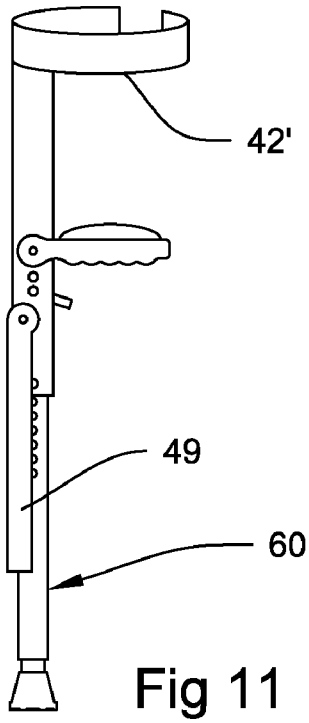
Fig 11
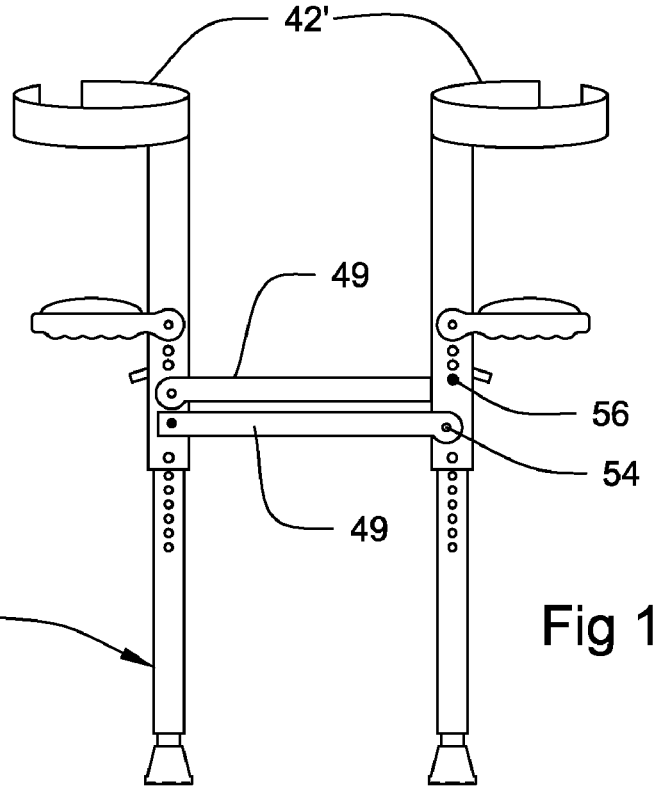
Fig 12

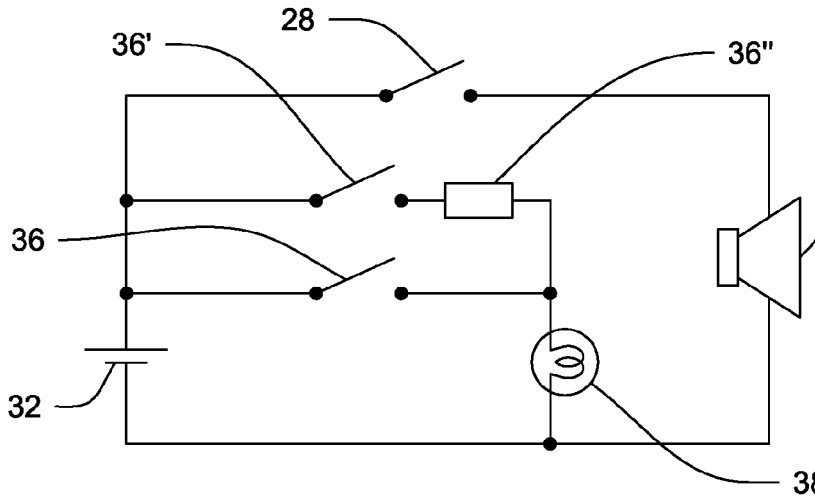
Fig 13
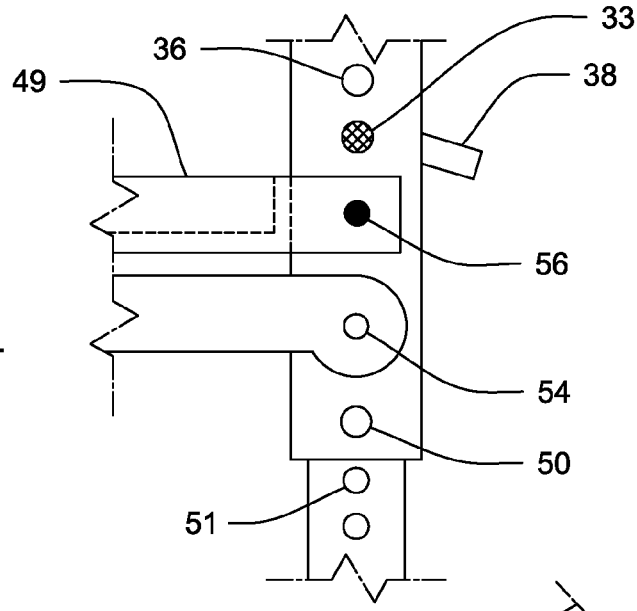
Fig 14
Fig 15
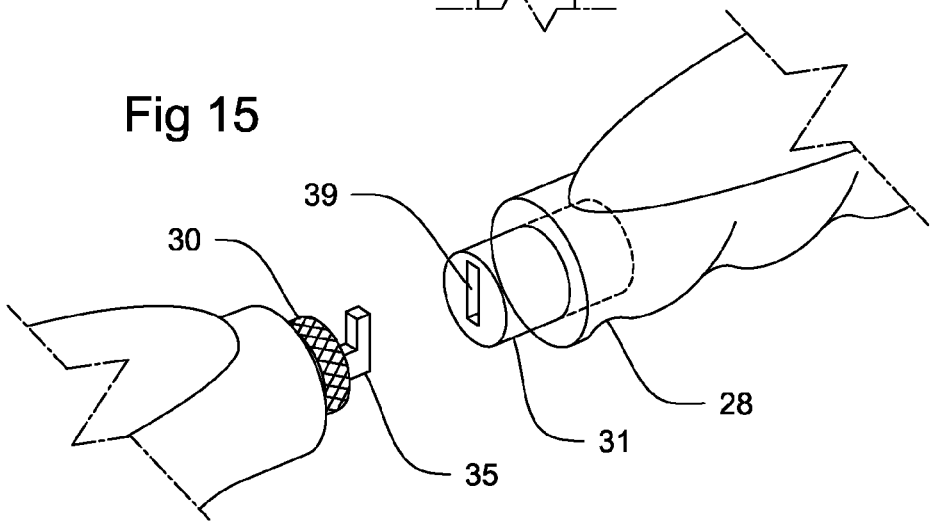

Fig 16
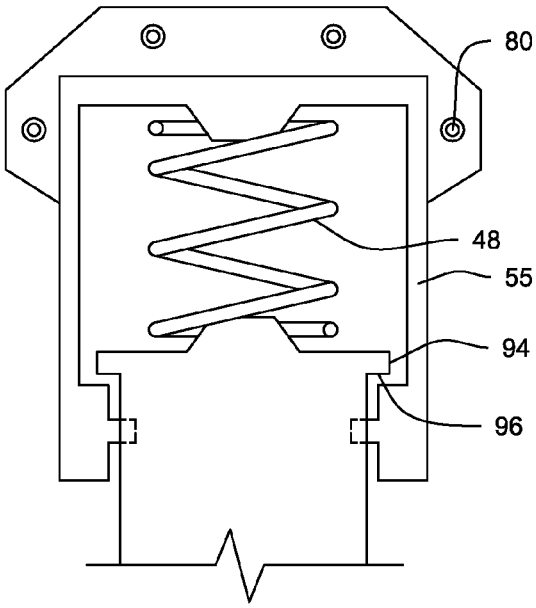
Fig 18
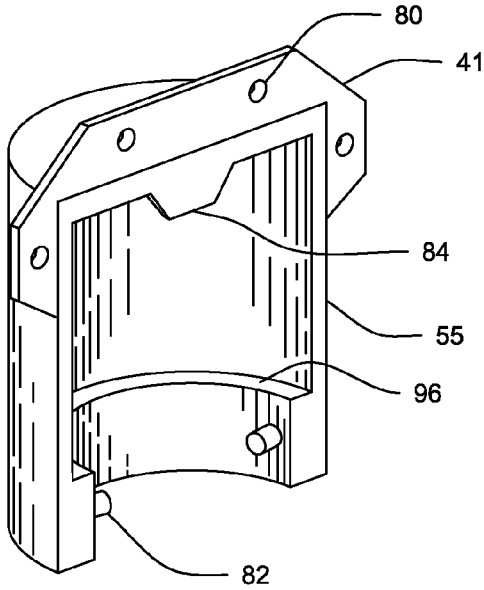
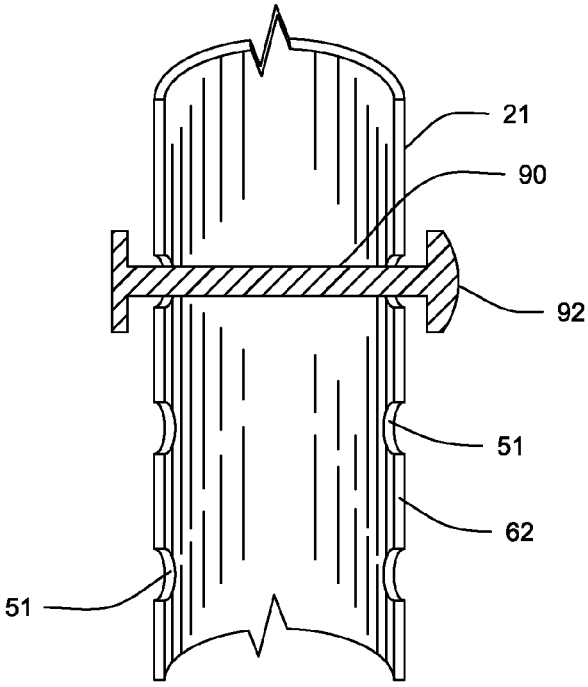
Fig 17
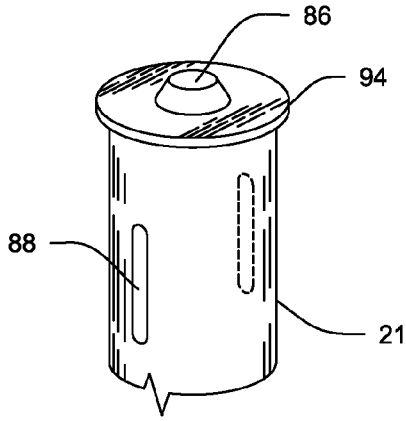
Fig 19

ERGONOMIC CRUTCHES

BACKGROUND OF THE INVENTION

1. Field of the Invention

The present invention relates to mobility assistance devices, and more particularly, to ergonomically improved crutches.

2. Description of the Related Art

Several designs for crutches have been created in the past. None of them, however, include the novel ergonomic features claimed herein including a mechanism to readily transform the handles of the crutches into a rigid, two leg chair that the user can use as a resting seat, nor a shock absorbing mechanism above the crutch handles, nor a resilient articulated handle.

Applicant believes that one of the closest references corresponds to U.S. Pat. No. 6,397,868 issued to John E. Smith for a Seat Suspended Between Crutches. The Smith patent is essentially a fabric sling draped between two traditional under-arm crutches to form a seat. To practice the Smith invention the feet of the crutches must be positioned very close together to keep the seat spread making the seat inherently unstable and causing the user to be squeezed when his/her weight is applied to the seat. The Smith patent differs from the present invention, inter alia, because the present invention has a rigid frame forming the seat which permits the legs to be firmly placed further apart giving the seat much needed lateral stability while at the same time preventing the user from being squeezed in the chair when sitting.

Several other crutches have designs implementing shock absorbing mechanisms near the foot of the crutch. However, none of them have a shock absorbing mechanism superior to the handle.

Applicant believes that the closest reference including a shock absorbing feature corresponds to U.S. Pat. No. 2,888,022 issued to W. F. Fanning for a Shock Absorber for Orthopedic Crutches. The Fanning patent teaches a shock absorber in the foot of a crutch. It differs from the present invention because the present invention has a shock absorbing mechanism mounted independently above the load-bearing hand support member thus giving the forearm or under-arm support member its own independent shock absorbing mechanism.

Furthermore, none of the references known to applicant include a handle that articulates relative to the crutch assembly frame to more ergonomically interface with the user's hand and wrist. This feature translates into a more comfortable and ergonomic crutch.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide the crutches user a seat integrated into the structure of the crutch that can be easily erected to allow the user to rest on a stable structure.

It is another object of the present invention to provide a more ergonomically designed forearm or underarm crutch increasing the comfort of the user by integrating an adjustable handle and, inter alia, shock absorbing features in the handle, the distal end of the crutch and the forearm cuff or underarm support. The foot of the crutch may have a shock absorbing mechanism. Another shock absorbing mechanism is mounted above the handle to independently cushion the forearm cuff or underarm support. The handle is adjustable to a range of angles to more closely align with the user's natural hand position and has integrated shock absorbing features.

It is still another object of this invention to provide features that increase the safety and/or comfort of the user.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 is an elevational view of the forearm crutch in one of the preferred embodiments.

FIG. 2 shows a partial view cross section of the shock absorber in the distal end of the stud assembly of the crutch at line 2 in FIG. 1.

FIG. 3 illustrates a partial elevational view of the handle, switches and light with a partial cross-section of the handle.

FIG. 4 is a partial elevational view of a pair of crutches that are joined through the handle connection to form a seat.

FIG. 5 is a partial cross-section view of the upper shock absorbing mechanism supporting the forearm cuff.

FIG. 9 is a perspective view of a forearm crutch with support arm lowered.

FIG. 10 is a perspective view of two complimentary forearm crutches connected to each other to form a seat with their respective support arms.

FIG. 11 is a perspective view of a forearm crutch with support arm lowered.

FIG. 12 is a perspective view of the crutches demonstrating a seat formed between the crutches by their respective support arms.

FIG. 13 is a circuit diagram plan of the crutch.

FIG. 14 is an elevation partial view of a pair of crutches showing the crutches connected by bar seat members to form a seat.

FIG. 15 is a perspective view showing the locking mechanism in the handle that joins the handles to form a seat.

FIG. 16 is a cross section elevation of the upper shock absorbing assembly.

FIG. 17 is a perspective cross-section view of the crutches height adjusting mechanism.

FIG. 18 is a perspective cross-section view of the bracket of the upper shock absorbing mechanism.

FIG. 19 is an isometric view of the superior end of the supporting frame.

DETAILED DESCRIPTION OF THE PREFERRED EMBODIMENT

Figure 6:
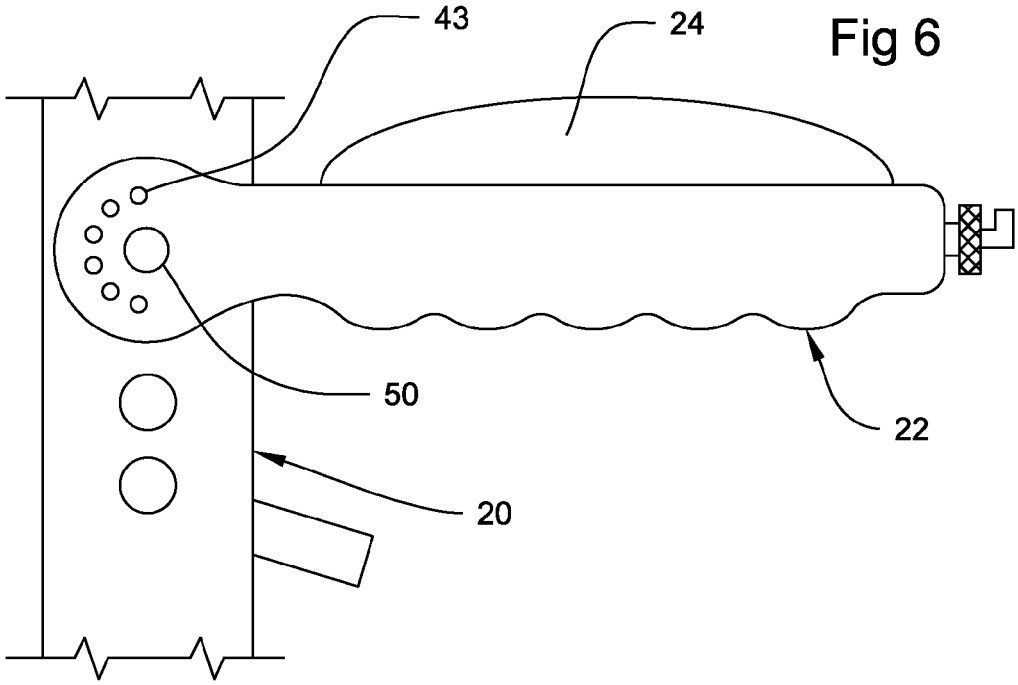
FIG. 6 is a partial elevation view of the handle area showing a mechanism to lock in an angular position of the handle.

Referring now to the drawings, where the present invention is generally referred to with numeral 10, it can be observed that it basically includes three major sectional components: a frame assembly 20, a stud assembly 60 and an upper assembly 40. These assemblies can be seen best generally in FIG. 1.

The frame assembly 20 is generally tubular. A light source 38 is mounted to frame assembly 20 and is controlled by switches 36 and 36' to turn on and off. Light source 38 functions as a pathway light and alternately by actuating switch 36', a flashing light beacon. Superior to the light source is adjustably and pivotally mounted handle assembly 22. The handle is a load bearing member. To the top of the handle assembly 22 is affixed a resilient hand cushion 24. Hand cushion 24 includes a handle shock absorbing assembly 25 comprised of coil springs 27. In the handle shock absorbing assembly 25 the coil springs 27 can substituted for or augmented by an oil or pneumatic dampener or a leaf spring. Inside handle assembly 22 is a battery 32 accessed through a snap-on door 34. A horn switch 28 is located under the handle assembly 22 that selectively activates horn 33 that is integrated in the supporting frame 21.

In one of the preferred embodiments of the seat feature (FIG. 4, generally, and FIG. 15), inside one handle of the pair is nested a slidably extendable and rotatable connecting bar 26 which slides partly out of the handle to firmly mate at the tip by rotating knurled grip 30 integrally connected to key 35 with a corresponding key slot 39 in receiving member 31 on the opposite crutch handle 28 to form a seat. Alternatively, connecting bar 31 may also be extendable so that the width of the seat to be increased further.

Another embodiment of the seat feature is depicted in FIGS. 9 and 10, generally. In this embodiment a hinged support arm 47 is hingedly mounted to frame assembly 20 by means of hinge pin 52. On the first crutch of a pair, the tip of the hinged support arm 47 opposite the hinge pin 52, is generally cylindrical and hollow and the corresponding mating tip 53 of the hinged support arm 47 of the second crutch of the pair has a smaller diameter sized to fit inside said tip of the first hinged support arm 47. To form a seat the hinged support arms 47 of both crutches of a pair of crutches is raised and firmly mated with the tip of the corresponding hinged support arm 47 from the opposite crutch.

Yet another embodiment of the seat feature is depicted in FIGS. 11, 12 and 14. In this embodiment a longer hinged support arm 49 is hingedly mounted to frame assembly 20 by means of hinge pin 54. To form a seat the longer hinged support arm 49 is raised and its distal end is secured to frame assembly 20 by locking pin 56 of the corresponding crutch.

As shown in FIG. 6 the handle assembly 22 is connected to the supporting frame assembly 20 by axle pin 50. The angle position of the handle assembly relative to the supporting frame is selected and fixed by a pin penetrated through one of the pre-determined angle selector holes 43 radially situated around the axle pin 50 and through a corresponding hole in the main frame.

Figure 7:
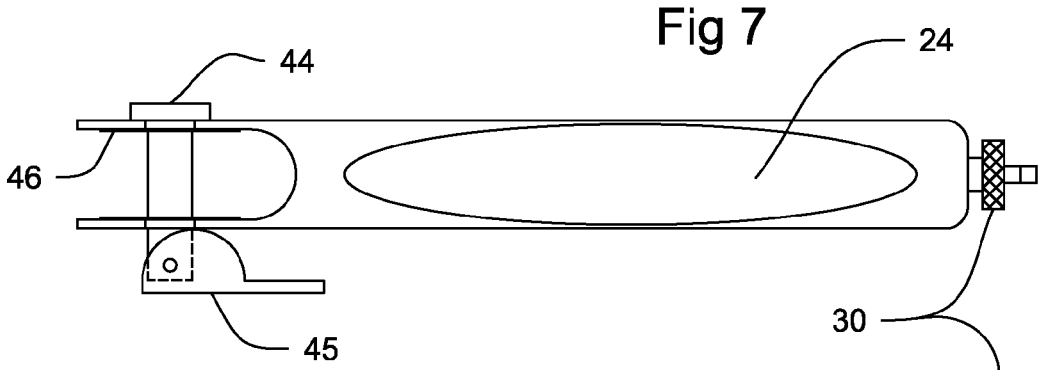
FIG. 7 is a top elevation view of an alternate embodiment mechanism to lock in the handle at a predetermined angular position.
Figure 8:
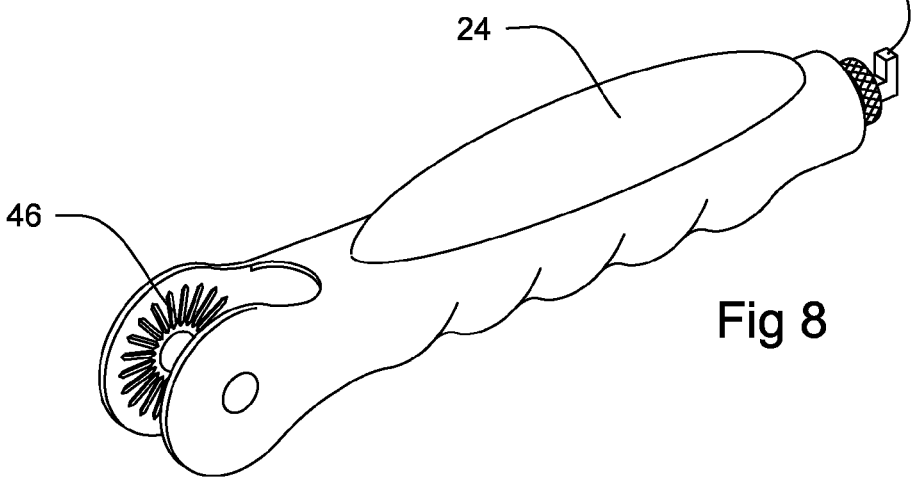
FIG. 8 is a perspective view of the handle with an alternate mechanism to lock in the angle of the handle.

Alternatively, the angle of the handle assembly 22 relative to the supporting frame 21 may be adjusted and fixed by a combination of radial grooves 46 and cam lock 45 as shown in FIGS. 7 and 8. In this embodiment said radial grooves 46 oriented on radii around an axle pin 44 on the handle integrate with corresponding grooves oriented on radii around the axle pin hole through the supporting frame. Said radial grooves 46 on the handle section and said corresponding radial grooves on the supporting frame firmly engage each other by means of the axle pin 44 and cam lock 45 that press the radial grooves 46 on the handle into said corresponding radial groves on the supporting frame effectively selecting the predetermined angle between the handle assembly 22 and frame assembly 20.

As shown in FIG. 1, generally, and in detail in FIG. 17 stud assembly 60 of the forearm crutch includes a stud section 62 that is telescopically received by the distal end of the supporting frame 21 and a gripping shoe assembly 64. The stud section 62 has a two series of height adjustment holes 51 at predetermined positions on opposite sides and along the axis of said stud section 62. The supporting frame 21 has a pair of holes 50 on opposite sides of the distal end. The stud section 62 is fixed at a selected height into the supporting frame 21 by a pin 90 secured into place by a hitch pin 92. Alternatively, the height of the crutches may be selected by a spring plug located inside the stud section 62 and selected to fit into any of said series of height adjustment holes 51 and the corresponding hole on the distal end of the supporting frame 21 to accommodate variations in the height of different users.

The distal end of the lower stud section houses a shock absorbing assembly, FIG. 2, generally. A spring 64 (or hydraulic or other means not depicted) biases the distal end of the stud section 62 and the gripping shoe assembly 64 apart with predetermined force and elongated axially. The foot of the lower tubular member is capped by a ground contacting gripping shoe 66.

An upper assembly 40 is shown in FIG. 5 and its subassemblies are shown in more detail in FIGS. 16, 18 and 19 and is comprised of a forearm cuff 42, a spring 48 (or hydraulic or other means not depicted) and shock absorber body 55 with integrated mounting bracket 41. The shock absorber body 55 is fixed onto the forearm cuff 42 by rivets 80, screws, welds or other fixative means. The spring 48 is seated on spring seat 84 on one end and spring seat 86 on its opposite end. Said spring 48 biases the shock absorber body 55 (and therefore also the forearm cuff) apart from the supporting frame 21 with a predetermined resistance to provide a shock absorbing feature.

The upper shock absorbing mechanism is shown in more detail in FIGS. 16, 18 and 19 where it is shown that the superior end of the supporting frame 21 has a ridge 94 that contacts a ledge 96 prevents the supporting frame 21 from separating from the shock absorber body 55. The shock absorber body 55 and supporting frame 21 are prohibited from rotating axially relative to each other by means of a channel 88 vertically oriented in the superior end of the supporting frame 21 which mates with and is commensurate in depth with the length of an alignment pin 82 on the interior of the shock absorber body 55. Optionally, there may be more than one pair of said channel 88 and corresponding alignment pin 82 situated around the superior end of the supporting frame 21 and corresponding surface of the shock absorber body 55.

The forearm cuff 42 as shown generally in FIG. 1 is shaped to ergonomically conform to the users forearm for maximum comfort. Another acceptable shape of a forearm cuff 42' is shown generally in FIGS. 9 through 12. Likewise a traditional underarm support may be used instead of a forearm cuff and effectively employ and enjoy the same features as would a crutch using a forearm cuff.

FIG. 13 shows a circuit diagram of the electrical components. Element 32 is the battery. Switch 36 turns the light 38 on and off and switch 36' in combination with a flasher means 36" to provide a flashing light feature for light 38. Horn switch 28 selectively activates horn 33.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An ergonomic crutch, comprising:

A) a supporting frame having a substantially tubular shape having a hollow interior and further including a proximal end and a distal end; the distal end of said supporting frame having a stud receiving end portion;

B) a stud assembly having a ground contacting end and an upper end; said stud assembly being telescopically and coaxially mounted at said upper end to said distal end of said supporting frame; said supporting frame secured to said stud assembly at one of a plurality of predetermined positions along the longitudinal axis of said stud assembly and said stud assembly further comprising coaxially disposed shock absorbing means cooperatively attached by said ground contacting end;

C) a handle is mounted to said supporting frame and is selectively adjusted at an angular position relative to said supporting frame; and D) an upper support member and a shock absorbing means cooperatively attached to the distal end of said upper support member and to the proximal end of said supporting frame wherein said upper support member is a cuff that contacts the user's upper arm or forearm and said handle is moveable between two extreme angular portions within one place and without requiring the rotation of said handle, said handle further including shock absorbing means to cooperatively transmit a user's load through his or her hand.

2. An ergonomic crutch as set forth in claim 1 further comprising a light source, a battery, an audible horn and circuit and switching means for controlling said audible horn and light source.

3. An ergonomic crutch as in claim 2 that further comprises a support arm hinged at the base of said handle that is held parallel to the supporting frame and stud distal to said handle and can be raised to substantially horizontal and the tip of said support bar opposite the hinge may be fixed to a receiving means on the supporting frame distal to the handle of the other crutch of a pair.

4. An ergonomic crutch as in claim 2 that further comprises a support arm hinged at the base of said handle that is held parallel to the supporting frame and stud distal to said handle and can be raised to substantially horizontal and the tip of said support bar opposite the hinge may be fixed to a receiving means on the said tip of the support arm of the other crutch of a pair.

5. An ergonomic crutch as in claim 1 further comprising a connecting bar slidably extendable from said handle which mates and positively locks with a corresponding bar slidably extendable from said handle of another crutch of a pair thereby resulting in seating support.

6. An ergonomic crutch as in claim 5 that further comprises a connecting bar slidably extendable from the tip of said handle which mates and positively locks with a corresponding bar slidably extendable from handle of the other crutch of a pair.

7. An ergonomic crutch as in claim 1 that further comprises a support arm hinged at the base of said handle that is held parallel to the supporting frame and stud distal to said handle and can be raised to substantially horizontal and the tip of said support bar opposite the hinge may be fixed to a receiving means on the supporting frame distal to the handle of the other crutch of a pair thereby resulting in seating support.

8. An ergonomic crutch as in claim 1 that further comprises a support arm hinged at the base of said handle that is held parallel to the supporting frame and stud distal to said handle and can be raised to substantially horizontal and the tip of said support bar opposite the hinge may be fixed to a receiving means on the said tip of the support arm of the other crutch of a pair.

* * * * *